US008534324B2

(12) United States Patent
Schulman

(10) Patent No.: US 8,534,324 B2
(45) Date of Patent: Sep. 17, 2013

(54) SUMP PUMP WITH REDUCED-NOISE CHECK VALVE

(76) Inventor: Alan M. Schulman, Riverwoods, IL (US)

( * ) Notice: Subject to any disclaimer, the term of this patent is extended or adjusted under 35 U.S.C. 154(b) by 1913 days.

(21) Appl. No.: 11/586,231

(22) Filed: Oct. 25, 2006

(65) Prior Publication Data

US 2007/0098582 A1 May 3, 2007

Related U.S. Application Data

(60) Provisional application No. 60/731,306, filed on Oct. 28, 2005.

(51) Int. Cl.
*F16K 15/14* (2006.01)

(52) U.S. Cl.
USPC ..... 137/855; 138/26

(58) Field of Classification Search
USPC ..... 137/855; 138/26, 30; 417/540, 417/543, 544
See application file for complete search history.

(56) References Cited

U.S. PATENT DOCUMENTS

| | | | | | |
|---|---|---|---|---|---|
| 2,312,290 | A | * | 2/1943 | Smith et al. | 137/527.4 |
| 2,355,357 | A | * | 8/1944 | Adams et al. | 60/405 |
| 2,416,025 | A | | 2/1947 | Shaff | |
| 2,563,862 | A | | 8/1951 | Nechine | |
| 3,019,818 | A | | 2/1962 | Everett | |
| 3,633,627 | A | | 1/1972 | Perrott et al. | |
| 3,828,806 | A | | 8/1974 | Glos, II | |
| 4,215,975 | A | | 8/1980 | Niedermeyer | |
| 4,631,001 | A | | 12/1986 | Keech | |
| 4,646,782 | A | * | 3/1987 | Ezekoye | 137/527.8 |
| 4,819,698 | A | | 4/1989 | Ismert | |
| 5,297,939 | A | | 3/1994 | Orth et al. | |
| 5,385,172 | A | | 1/1995 | Perrott et al. | |
| 6,095,195 | A | | 8/2000 | Park et al. | |
| 6,148,852 | A | | 11/2000 | Osterman | |

* cited by examiner

*Primary Examiner* — Kevin Lee
*Assistant Examiner* — Macade Brown
(74) *Attorney, Agent, or Firm* — Nixon Peabody LLP

(57) ABSTRACT

A system is provided for reducing noise produced by a falling liquid column in a discharge line connected to a sump pump through a flapper valve, when the flapper valve is moved from an open position to a closed position. The system includes a closed-end tube in fluid communication with the flapper valve and the discharge line to receive a portion of the residual head of liquid in the discharge line upon closing of the flapper valve when the pump is turned off.

7 Claims, 6 Drawing Sheets

SUMP PUMP WITH REDUCED-NOISE CHECK VALVE

CROSS-REFERENCE TO RELATED APPLICATION

This application claims the benefit of U.S. Provisional Application No. 60/731,306, filed Oct. 28, 2005, which is hereby incorporated by reference in its entirety.

FIELD OF THE INVENTION

This invention is related to check valve assemblies for use with sump pumps.

SUMMARY OF THE INVENTION

In accordance with one embodiment of the present invention, a system is provided for reducing noise produced by a falling liquid column in a discharge line connected to a sump pump through a check valve, when the check valve is moved from an open position to a closed position. The system includes a closed-end tube in fluid communication with the check valve and the discharge line to receive a portion of the residual head of liquid in the discharge line upon closing of the check valve when the pump is turned off.

In one implementation, the check valve includes a resilient flapper valve element in a valve body attached to the discharge port of the sump pump. The flapper valve element moves between open and closed positions. The portion of the valve body on the side of the flapper valve element facing away from the pump forms a side-wall port, and is also connected to a discharge line. A closed-end tube encloses the side-wall port and extends away from the valve body in the direction of the discharge line, to receive a portion of the residual head of liquid in the discharge line upon closing of the flapper valve when the pump is turned off.

BRIEF DESCRIPTION OF THE DRAWINGS

The invention may best be understood by reference to the following description taken in conjunction with the accompanying drawings, in which.

DETAILED DESCRIPTION OF ILLUSTRATED EMBODIMENT

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Turning now to the drawings, a check valve assembly 10 is adapted to be attached to the discharge port of a sump pump (not shown). The movable valve element is a conventional flapper valve element 11 contained between a pair of body members 12 and 13 connected between the pump discharge nozzle and a pipe or hose extending upwardly away from the sump pump for carrying liquid discharge from the sump to a suitable drain. The two body members 12 and 13 and the flapper valve element 11 all have mating outer flanges, each of which forms four registered holes for receiving four screws 12*a-d* that thread into tapped holes in the outer body member 13 to draw the body members 12 and 13 tightly against opposite sides of the flapper valve element.

Figure 8:
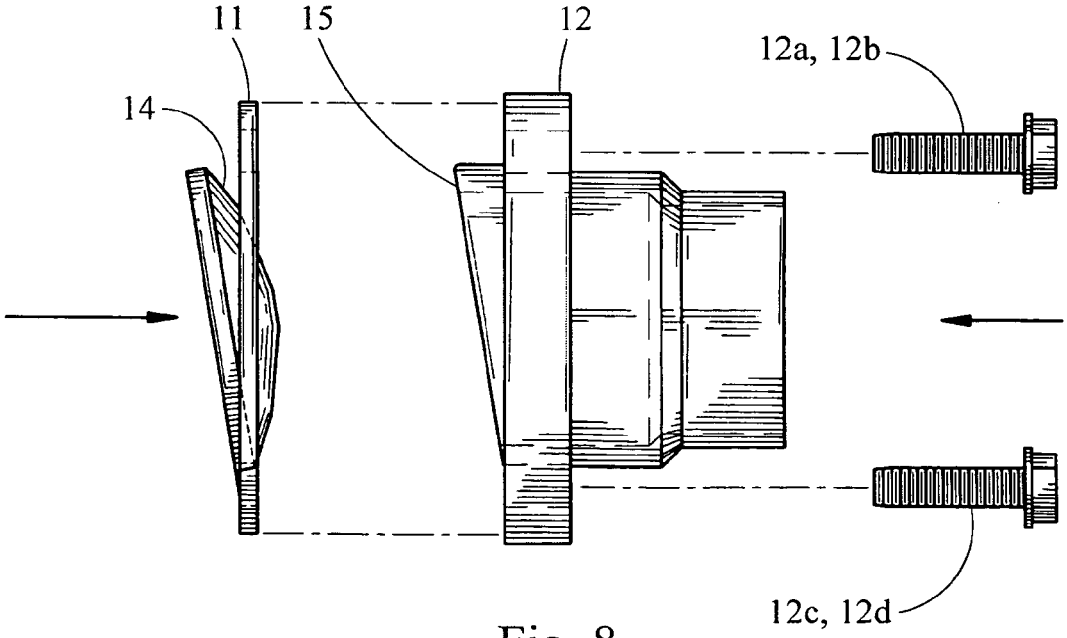
FIG. 8 is an exploded side elevation of the right-hand body section, the flapper valve element and the attachment screws in the assembly of FIGS. 1-4.
Figure 9:
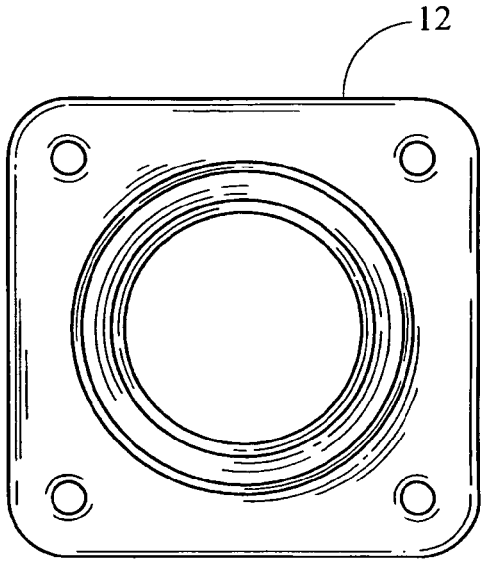
FIG. 9 is an end elevation taken from the left-hand end of FIG. 8.
Figure 10:
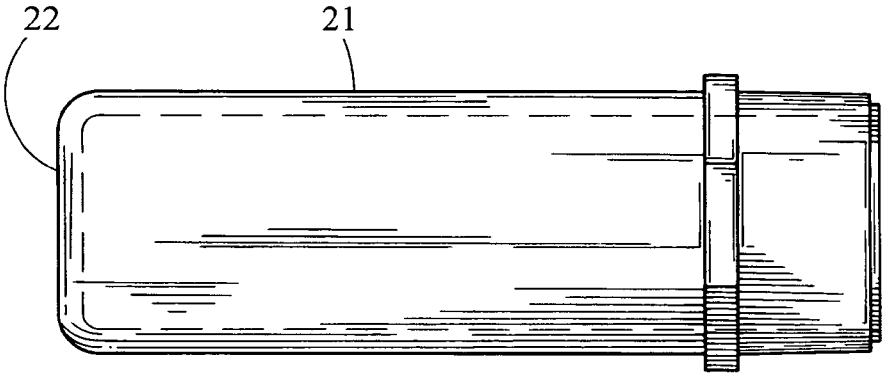
FIG. 10 is a side elevation of the closed-end tube section attached to the left-hand body section in the assembly of FIGS. 1-4.
Figure 11:
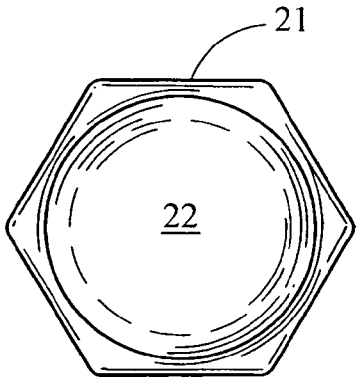
FIG. 11 is an end elevation taken from the right-hand end of FIG. 10.

A circular, cupped central portion 14 of the flapper valve element 11, which is made of a resilient material such as rubber, is hinged to the outer portion of the valve element on only one side so that the remainder of the central portion 14 can pivot between open and closed positions. The portion of the inner body member 12 adjacent the movable central portion 14 of the flapper valve element forms an annular seating surface 15 for the mating outer annular portion of the central portion 14. As can be seen in FIG. 8, the seating surface 15 lies in a plane that intersects the center line of the valve assembly at an acute angle, which has the effect of reducing the distance through which the valve element must move between its open and closed positions.

When the sump pump is operating, the hydraulic pressure produced by the pump forces the flapper valve element 11 to its open position, allowing liquid to be discharged from the pump into the outer body member 13 and then on into the discharge line attached to that outer body member. When the pump is turned off, the resilience of the flapper valve element 11 causes it to return toward its closed position, and the hydraulic head produced by the column of liquid in the discharge line forces the flapper valve element 11 tightly against the seating surface 15 so that liquid from the discharge line cannot flow back into the pump.

Figure 1:
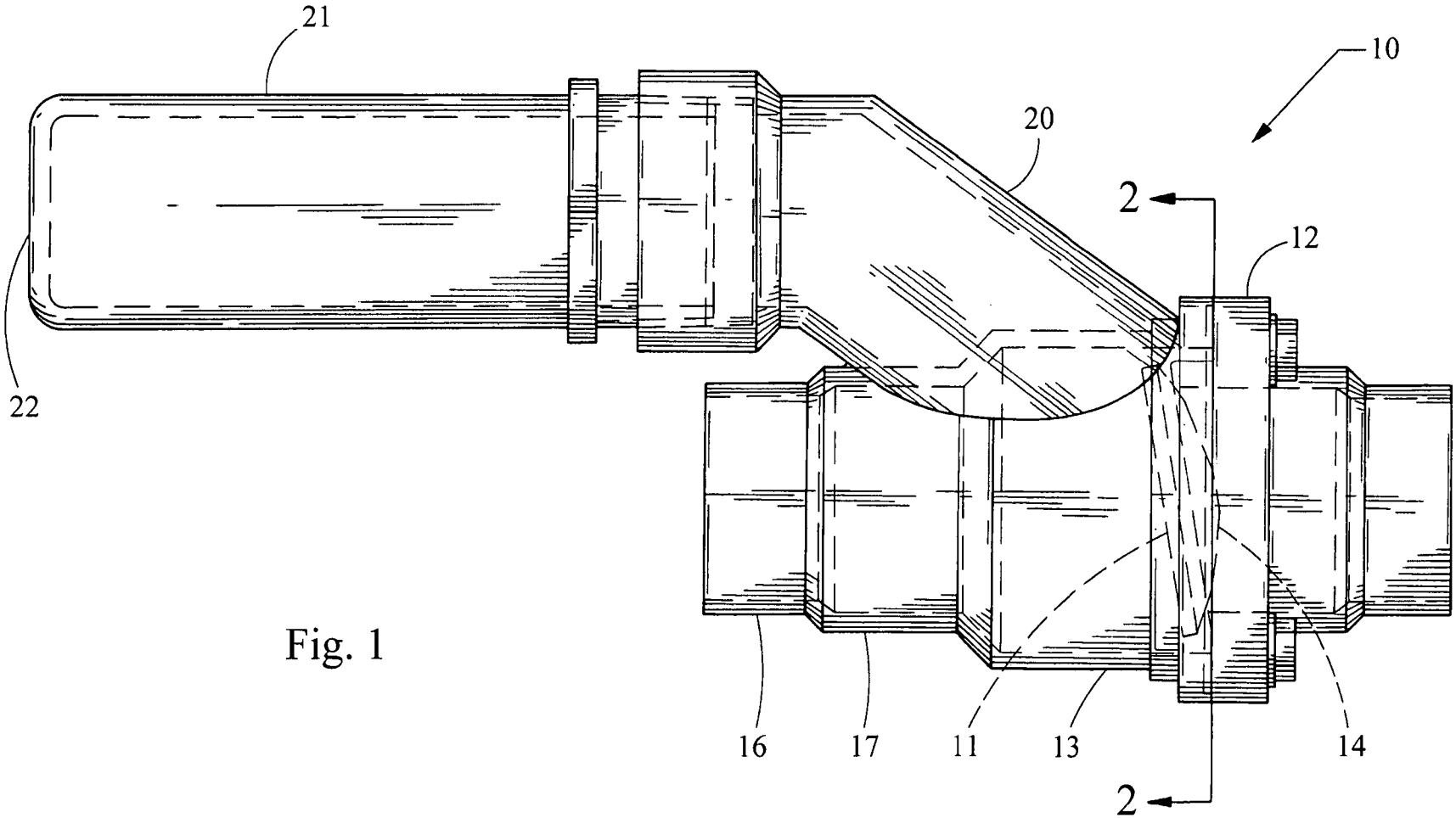
FIG. 1 is a side elevation of a check valve assembly embodying the invention.
Figure 2:
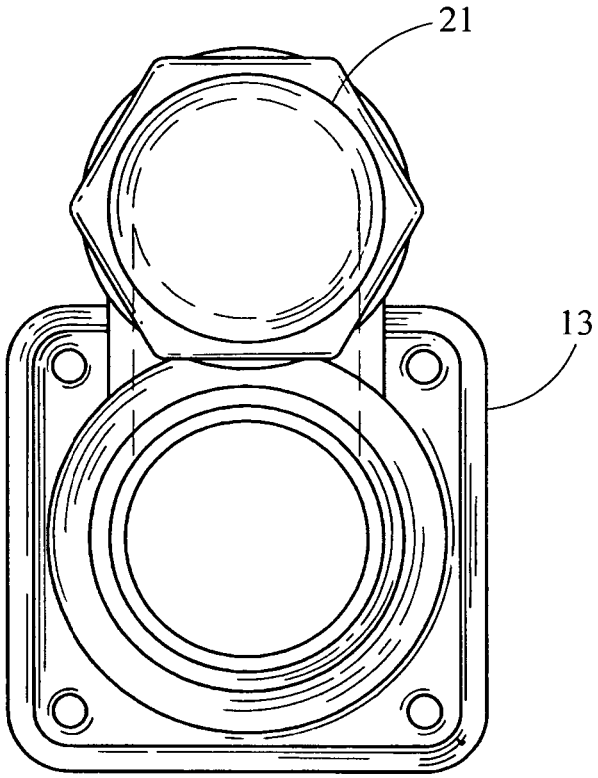
FIG. 2 is an end elevation taken from the left-hand end of FIG. 1.
Figure 4:
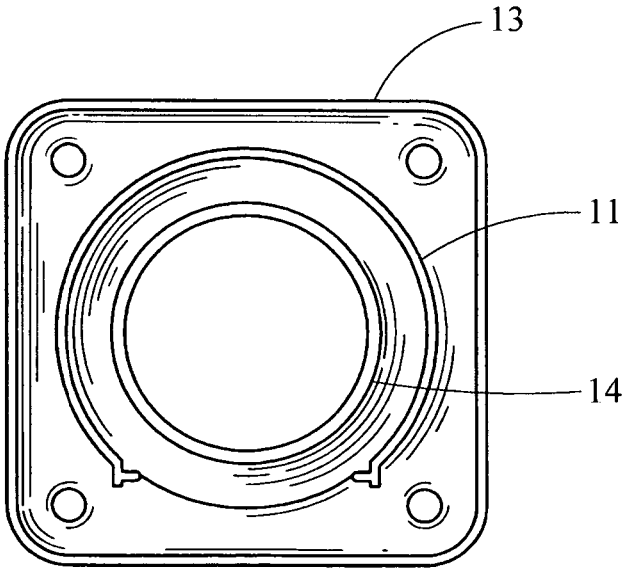
FIG. 4 is a section taken along line 2-2 in FIG. 1.
Figure 3:
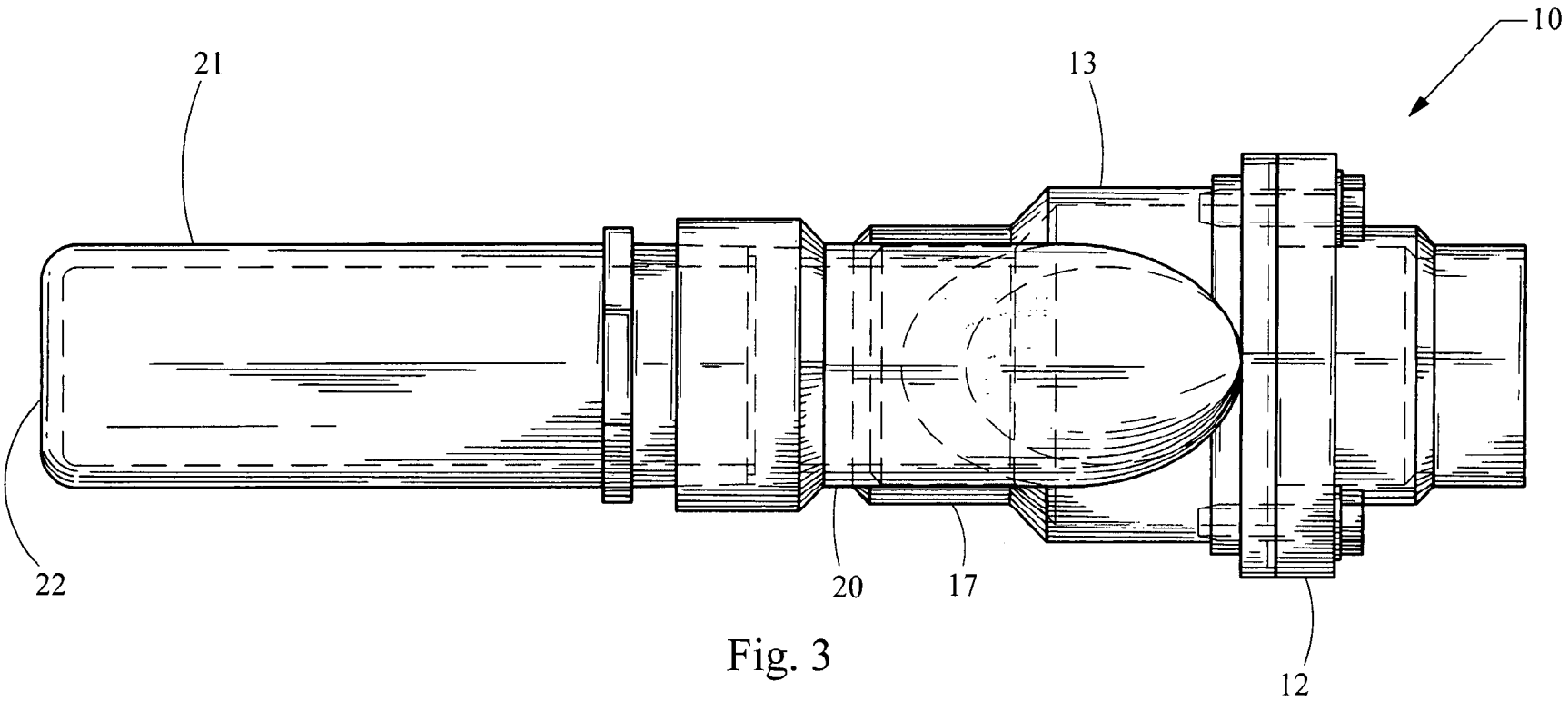
FIG. 3 is a top plan view of the assembly of FIGS. 1 and 2.
Figure 5:
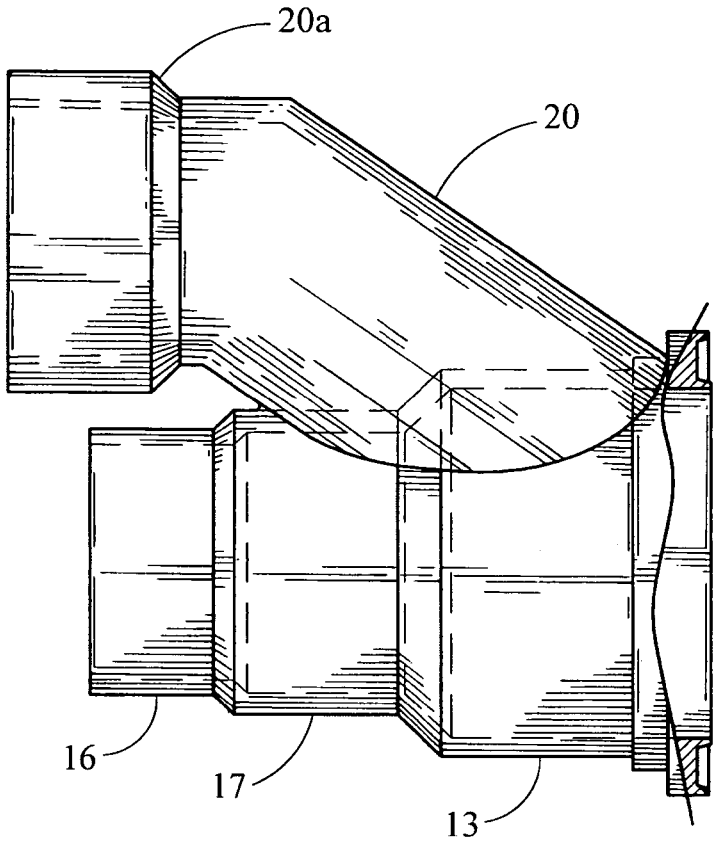
FIG. 5 is a side elevation of the left-hand body section in the assembly of FIGS. 1-4.
Figure 6:
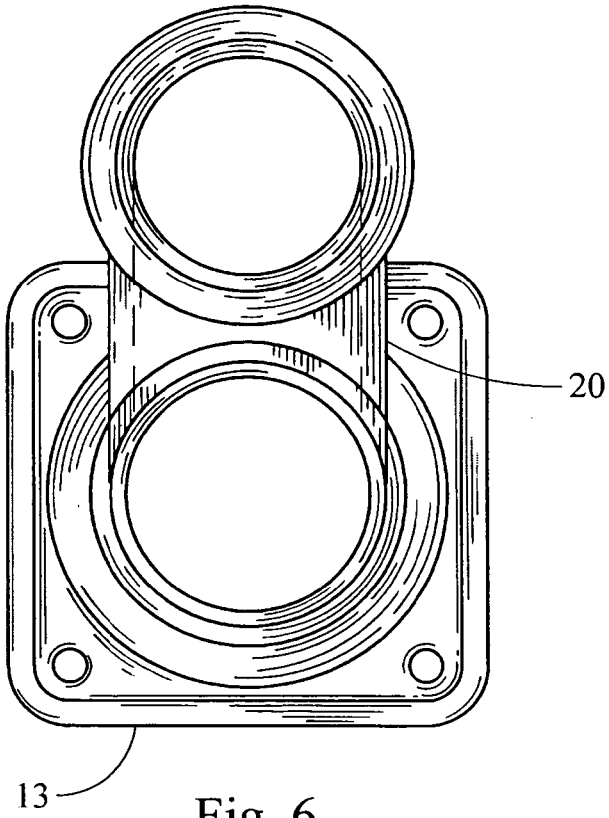
FIG. 6 is an end elevation taken from the left-hand end of FIG. 5.
Figure 7:
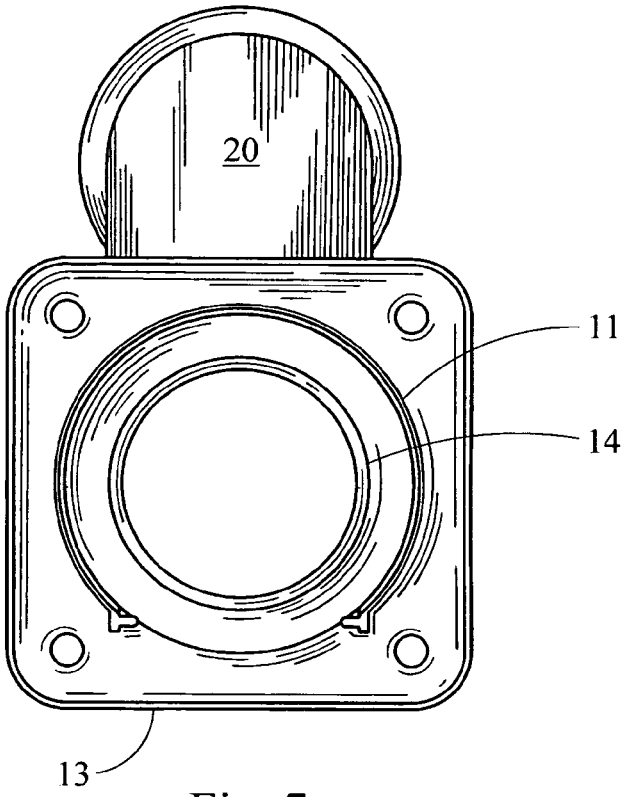
FIG. 7 is an end elevation taken from the right-hand end of FIG. 5.

As can be seen in FIG. 5, the outer body member 13 is stepped so that it can receive discharge lines of different diameters. For example, the outermost segment 16 of the outer body member 13 may have a diameter selected to receive a standard 1.25-inch PVC pipe, while the next segment 17 has a diameter selected to receive a standard 1.5-inch PVC pipe.

Extending laterally away from the inner end portion of the outer body member 13 is an elbow section 20 that joins the body member 13 to a closed-end tube 21 extending generally parallel to the discharge line attached to the body member 13. In the example illustrated, the central axis of that portion of the elbow section 20 joined to the body member 13 intersects the central axis of the body member at an angle of about 35 degrees, although it will be understood that other angles may be used. The central axis of the outer portion of the elbow section 20 is generally parallel to the central axis of the body member 13. The outer end of the elbow section 20 is stepped outwardly at 20*a* to fit over the outer surface of the open end of the tube 21 that is closed at its opposite end 22. The elbow section 20 and the closed-end tube 21 may be joined with conventional PVC adhesive, or they may be threaded to allow them to be threaded together. The elbow section 20 is preferably formed as an integral part of the outer body member 13, such as by molding them as a single unitary part.

The purpose of the elbow section 20 and the closed-end tube 21 is to reduce the noise produced when the flapper valve closes. When the sump pump is turned off, the substantial column of liquid that exists in the discharge line typically falls and slams the flapper valve closed, sometimes vibrating the valve element in the process, producing substantial noise. However, with the auxiliary chamber formed by the elbow 20 and the tube 21, a portion of the liquid column in the discharge line flows into the elbow section 20, forcing liquid from the elbow section 20 up into the tube 21, which has the effect of substantially reducing the amount of noise produced by the closing of the flapper valve element. The closed-end tube 21 preferably contains a volume of air, so that the liquid that enters the elbow section 20 and the tube 21 compresses the air within the tube, thus dissipating a portion of the energy of the falling liquid column.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

The invention claimed is:

1. A check valve assembly for the discharge port of a sump pump, comprising a resilient flapper valve element, a valve body adapted for connection to the discharge port of a sump pump and containing said flapper valve element for movement between open and closed positions, the side wall of said valve body on the side of said flapper valve element facing away from said pump forming a port, and a portion of said valve body on the side of said flapper valve element facing away from said pump being adapted for connection to a discharge line, and an empty closed-end tube enclosing said side-wall port and extending away from said pump to receive a portion of the residual head of liquid in said discharge line upon closing of said flapper valve element when the pump is turned off.

2. The check valve assembly of claim 1 in which said closed-end tube contains a volume of air when connected to said pump and discharge line, so that the liquid that enters said closed-end tube when said flapper valve closes compresses the air within said tube, thus dissipating a portion of the energy of the entering liquid.

3. The check valve assembly of claim 1 in which said closed end tube extends laterally away from said flapper valve element.

4. The check valve assembly of claim 1 in which said portion of said valve body adapted for connection to a discharge line is stepped to facilitate connection to discharge lines of different sizes.

5. A method of reducing noise produced by a falling liquid column in a discharge line connected to a sump pump through a flapper valve when the flapper valve is moved from an open position to a closed position, said method comprising providing an empty closed-end tube in fluid communication with said flapper valve and said discharge line to receive a portion of the residual head of liquid in said discharge line upon closing of said flapper valve element when the pump is turned off.

6. The method of claim 5 in which said closed-end tube contains a volume of air when connected to said pump and discharge line, so that the liquid that enters said closed-end tube when said flapper valve closes compresses the air within said tube, thus dissipating a portion of the energy of the entering liquid.

7. The method of claim 5 in which said closed end tube extends away from said flapper valve in the direction of said discharge line.

* * * * *